US011332288B2

(12) United States Patent
Anh

(10) Patent No.: US 11,332,288 B2
(45) Date of Patent: May 17, 2022

(54) BLISTER PACKAGE HAVING APPLICATOR THEREIN

(71) Applicant: BLISSPACK CO., LTD., Gyeonggi-do (KR)

(72) Inventor: Jong-Won Anh, Seoul (KR)

(73) Assignee: BLISSPACK CO., LTD., Gyeonggi-do (KR)

( * ) Notice: Subject to any disclaimer, the term of this patent is extended or adjusted under 35 U.S.C. 154(b) by 6 days.

(21) Appl. No.: 16/393,030

(22) Filed: Apr. 24, 2019

(65) Prior Publication Data

US 2020/0339326 A1 Oct. 29, 2020

(51) Int. Cl.

| | |
|---|---|
| ***B65D 51/32*** | (2006.01) |
| ***A45D 34/04*** | (2006.01) |
| ***A45D 40/00*** | (2006.01) |

(52) U.S. Cl.

CPC ..... *B65D 51/32* (2013.01); *A45D 34/046* (2013.01); *A45D 40/0087* (2013.01)

(58) Field of Classification Search

CPC .. B65D 51/32; A45D 34/046; A45D 40/0087; A45D 40/265; A45D 40/267

USPC ..... 206/229, 581, 207, 209, 210, 461, 467, 206/469, 471, 466, 823; 401/126, 129, 401/122, 121, 124, 132, 133, 135

See application file for complete search history.

(56) References Cited

U.S. PATENT DOCUMENTS

| | | | | |
|---|---|---|---|---|
| 3,353,898 | A * | 11/1967 | Lamberti | A46B 11/0003 401/132 |
| 3,549,036 | A * | 12/1970 | Ritsi | A61J 11/008 215/11.6 |
| 4,982,838 | A * | 1/1991 | Fitjer | A45D 40/0087 132/317 |
| 5,743,279 | A * | 4/1998 | Gueret | A45D 40/267 132/218 |
| 6,241,132 | B1 * | 6/2001 | Morrison | B65D 75/5877 222/541.6 |
| 2003/0077104 | A1 * | 4/2003 | Schrepf | A45D 34/045 401/129 |
| 2009/0324318 | A1 | 12/2009 | Wilde et al. | |
| 2010/0032452 | A1 * | 2/2010 | Sibileau | B05B 11/00412 222/321.1 |

(Continued)

FOREIGN PATENT DOCUMENTS

| | | | |
|---|---|---|---|
| KR | 20-0316761 | Y1 | 6/2003 |
| KR | 10-2011-0030642 | A | 3/2011 |

(Continued)

*Primary Examiner* — J. Gregory Pickett
*Assistant Examiner* — Jenine Pagan
(74) *Attorney, Agent, or Firm* — IP Legal Services, LLC

(57) ABSTRACT

A blister container having an applicator therein, used for cosmetic, medical and industrial products that is convenient to use and allows realizing the function of liquid contents, more specifically, a blister container configured to have a lower portion for accommodating cosmetic liquid so that the dual function of accommodating liquid contents as well as packaging the applicator can be achieved at the same time, a middle portion connected to an upper side of the container portion, configured to have a wiper-attached shoulder to mount an applicator cap and adjust the application amount and the usage amount, and an upper portion formed with a handle-package portion for sealing the handle portion of an applicator-attached cap.

2 Claims, 8 Drawing Sheets

(56) References Cited

U.S. PATENT DOCUMENTS

| | | | | |
|---|---|---|---|---|
| 2010/0166488 | A1 | 7/2010 | Bouix et al. | |
| 2011/0299910 | A1* | 12/2011 | Crutchley | B65D 1/095 401/122 |
| 2012/0063835 | A1* | 3/2012 | Inoue | A45D 34/046 401/126 |
| 2013/0004228 | A1* | 1/2013 | Presche | A45D 40/268 401/122 |
| 2014/0027334 | A1* | 1/2014 | Ahn | B65D 75/326 206/467 |
| 2015/0366324 | A1* | 12/2015 | Jeong | A45D 40/265 220/62.22 |
| 2016/0249728 | A1* | 9/2016 | Hauger | A45D 40/0087 132/200 |

FOREIGN PATENT DOCUMENTS

| | | | |
|---|---|---|---|
| KR | 10-2013-0079667 | A | 7/2013 |
| KR | 10-2015-0017982 | A | 2/2015 |

* cited by examiner

- Related Art -

BLISTER PACKAGE HAVING APPLICATOR THEREIN

BACKGROUND

Field of the Invention

The present invention relates to a blister package having an applicator therein, including, a container portion that is blister-configured which accommodates liquid contents, a shoulder portion provided at an inlet of the container portion so as to have a function of adjusting the application amount of the liquid contents and mounting an applicator-attached cap, a coupling male-thread portion which is detachably attached to the shoulder portion and is fastened to a coupling female-thread portion, a handle and an applicator-fixing tube each of which is configured to protrude above and below the coupling male-thread portion, the applicator-attached cap configured to have an applicator inserted and fixed to the applicator-fixing tube via an applicator support, a handle-package portion that is blister-configured so as to be integrally formed extending from an upper part of the container portion to cover and protect the handle of the applicator-attached cap from the outside in a sealed state, and a tear-off inducing line provided transversely between the shoulder portion and the handle-package portion for setting a cut line for the removal of the handle-package portion and reducing cutting resistance, wherein the brush shoulder portion includes a shoulder fixedly attached to the inlet of the container portion, a wiper mounting hole of a wiper which is perforated at the center of the shoulder, and a coupling female-thread portion which is formed concavely around the wiper mounting hole, and having a liquid contents accommodating structure wherein, the coupling male-thread portion of the applicator-attached cap is fastened to the female-thread portion in a state where the wiper is inserted and fixed to the shoulder to fit and fix the applicator support to the applicator-fixing tube protruding through the wiper mounting hole so that the applicator-attached cap is coupled to the shoulder portion, and in such a state, after the inner surface of the inlet side of the container portion of the molding film, on which the molding of the handle-package portion and the tear-off inducing line is formed, is brought into contact with a curved front surface of the shoulder, the surfaces are integrally fixed.

Description of the Related Art

A blister package is typically a type of packaging as a thermoplastic plastic film or sheet and consists of a plastic laminate liner film or sheet that has been compressed or vacuum molded with contour blowing that approximates the shape of the article to be packaged is bonded with a cover film composed of paper or plastic laminated film using bonding methods of bonding only the flat flange portion of the container body by heat seal, high frequency, ultrasonic wave and such after putting contents into the bulging space of the container, and is used widely for packaging food, daily necessities, miscellaneous goods, industrial products, refined medicine, and liquid cosmetics.

An applicator is designed for convenient use of products. It is generally used as a tool with a brush, pad, sponge, etc. placed at one end to impregnate the contents, and is used in many fields such as cosmetics, medicines, household products and industrial products. Applicators are also used in many products, for example, cosmetic products such as mascara, eyeliner and lip gloss, industrial products such as nail remover, nail lacquer, coatings for car scratches, and medical products such as medicine applied to wounds and areas with trouble.

Here, the amount of impregnation or feeling of use varies depending on the shape and material of the applicator. However, in order to exhibit a constant amount of impregnation and a good feeling at all times, the functionality of the wiper used to leave only a certain amount of the applied amount on the applicator, and return the rest to the container is also very important.

As shown in FIG. 8, a conventional applicator built-in product has a brush 4 connected to an applicator support 5 integrally in the inside of a cap body 3, which is detachably screwed to an inlet of a container body 2, and a wiper 6 in the form of a single pipe is fixedly mounted on the inlet of the container body 2 for containing the cosmetic liquid to induce the application of a predetermined amount of the cosmetic solution through contact while maintaining an appropriate gap when the brush 4 is drawn out.

Such a conventional mascara is manufactured by molding a separate mold up to the cap body 3 and the brush 4 as well as the container body 2 for containing the mascara cosmetic solution, and then each has to be subject to an assembling process to be manufactured into a product. Thus, the number of molds needed increases, and the manufacturing process is complicated and the cost is increased due to the increase of the manufacturing cost.

Furthermore, in order to promote the mascara or eyeliner, it is necessary to have a similar structure when making a miniature or a sample. Thus, so far there has been almost no attempt to make a miniature or sample, and using one mascara product for many people is an unsanitary and so there was a tendency for both consumers and suppliers to avoid such situations.

However, the subject design simplifies the manufacturing process by using the blister packing method, dramatically reduces the manufacturing cost by minimizing parts, and is able to exhibit the functions of the product even as samples. Also, it is possible to commercialize products that apply similar applicators such as brushes and pads, for example, low-cost mascara, eyeliner, and lip gloss, and at the same time manufacture sanitary blister-type mascara, eyeliner and such blister-type products that can be commercialized.

SUMMARY

The present invention is directed to provide a small-capacity product or a blister package for sampling for products equipped with an applicator, thereby realizing the same function and feeling of use, while at the same time minimizing parts to decrease manufacturing costs and by allowing filling, storing of the applicator, attaching, sealing and cutting to be performed collectively, productivity can be improved, and also, by preventing the contact between the applicator and the cap before opening the package, deliberate contamination and unauthorized use can be prevented, and thus is capable of securing safety and reliability of the product.

According to an aspect of the present invention, in configuring the blister container, a lower portion of the blister container is configured by a container portion for accommodating cosmetic liquid so that the dual function of accommodating liquid contents as well as the package of the applicator can be achieved at the same time, a middle portion of the blister container is connected to the upper side of the container portion, and is configured to have a wiper support portion to mount an applicator cap and adjust the application amount and the usage amount, and an upper portion of the blister container is formed with a handle-package portion for sealing the handle portion of an applicator-attached cap.

The present invention is configured to have a container accommodating an applicator and product contents, a wiper assembled with the container to allow uniform application amount of the contents, an applicator, an inner cap for fixing the applicator, and an outer cap for having the inner cap therein. It is possible to inject contents into the container at the time of production, and breaking out from the conventional methods of closing the outer cap having an inner cap therein assembled with an applicator and then packaging a packaged product again with paper boxes or blister packing, a cap integrally formed with the applicator in advance is fixed to the blister and assembled to a sealed shoulder portion, and the assembled applicator and the shoulder portion are put into an existing blister manufacturing process to place in a shoulder storage portion of the molded blister container to bond with the shoulder storage portion of the blister container using heat, ultrasonic waves, high frequency waves and such methods, and after filling with contents, sealing by bonding with lead film again and performing cutting, it is possible to manufacture a blister package body having an applicator and the manufacturing process is shortened and the productivity can be improved.

In addition, the applicator can not be brought into contact with the applicator from the outside unless the handle-package portion is cut and opened. Thus, contamination or unauthorized use of the applicator can be prevented, and safety and reliability of the product can be ensured.

DETAILED DESCRIPTION OF THE EMBODIMENTS

Figure 1:
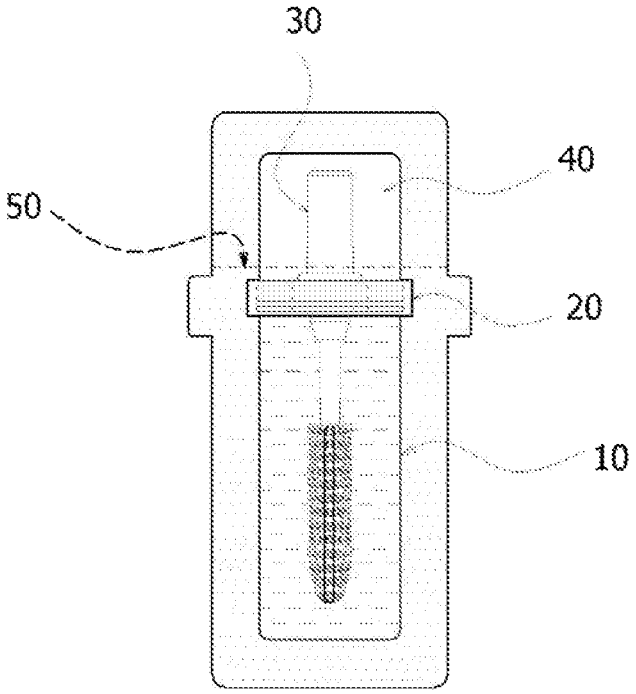
FIG. 1 is an exemplary front view illustrating an example of the configuration of the present invention.
Figure 2:
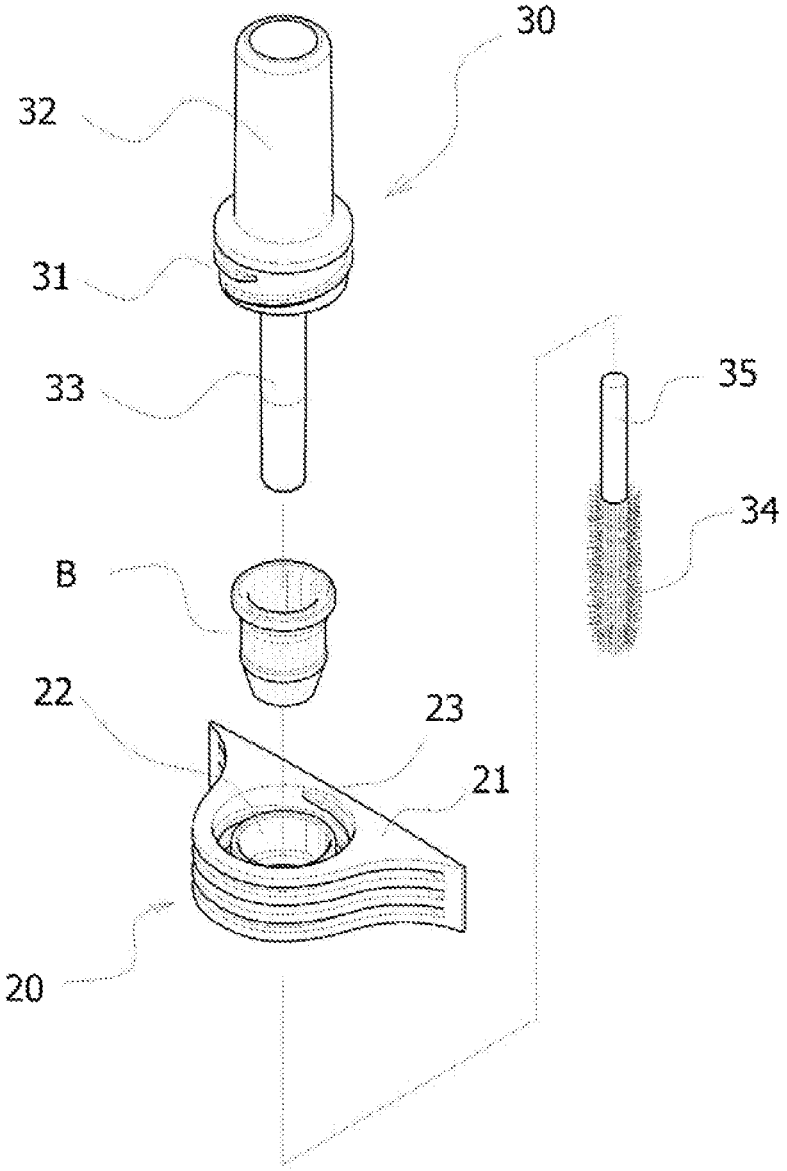
FIG. 2 is an exploded perspective view illustrating a configuration of an applicator-attached cap supporting portion and an applicator-attached cap coupled thereto according to the present invention.
Figure 4:
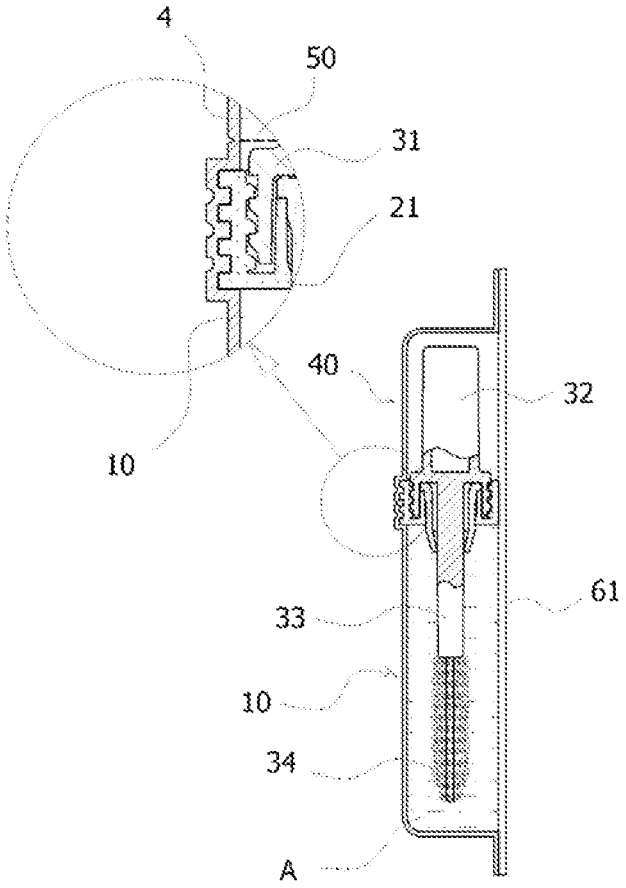
FIG. 4 is an exemplary cross-sectional view of an assembled and unopened state of the present invention.

FIG. 1 is an exemplary front view illustrating an example of the configuration of the present invention, and FIG. 4 is a cross-sectional view of an assembled and unopened state of the present invention.

The present invention relates to a blister package having an applicator therein, including, a container portion 10 that is blister-configured which accommodates liquid contents A, a shoulder portion 20 configured to have a shoulder 21, provided at an inlet of the container portion 10 so as to have a function of adjusting the application amount of the liquid contents and mounting an applicator-attached cap 30 which will be described below, a wiper-mounting hole 22 of a wiper B located inside the center of the shoulder 21 and a coupling female-thread portion 23 which is formed concavely around the wiper-mounting hole 22;

an applicator-attached cap 30 detachably attached to the shoulder portion 20 and configured to have, a coupling male-thread portion 31 which is fastened to a coupling female-thread portion 23, a handle 32, an applicator-fixing tube 33 each of which is configured to protrude above and below the coupling male-thread portion 31, and an applicator 34 inserted and fixed to the applicator-fixing tube 33 via an applicator support 35 fitted therein, a handle-package portion 40 that is blister-configured so as to be integrally formed extending from an upper part of the container portion 10 to cover and protect the handle 32 of the applicator-attached cap 30 from the outside in a sealed state, and a tear-off inducing line 50 provided transversely between the shoulder portion 20 and the handle-package portion for setting a cut line for the removal of the handle-package portion 40 and reducing cutting resistance.

60 is a molding film configuring the container portion 10 and the handle-package portion 40.

61 illustrates a cover paper for sealing the inlet of the molding film.

Hereinafter, the operation of the present invention will be described in detail.

Figure 3:
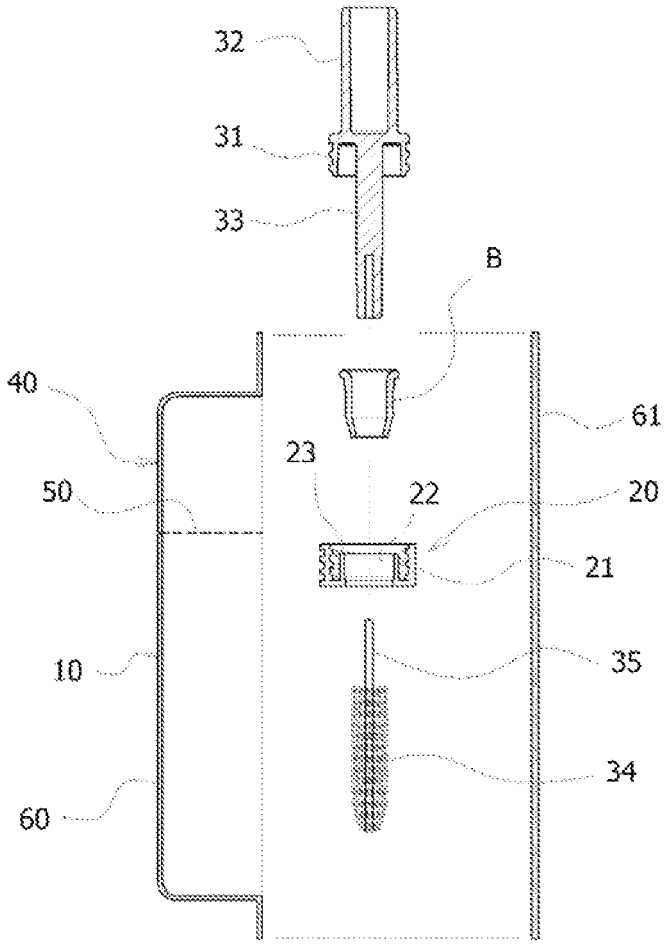
FIG. 3 is an exemplary cross-sectional view of an exploded state of the present invention.

The container to which the present invention is applied such that, as shown in FIG. 3, in a state where the wiper B is inserted and fixed to the shoulder portion 21, the coupling male-thread portion 31 of the applicator-attached cap 30 is fastened to the coupling female-thread 23 to fit and fix the applicator support 35 of the applicator 34 to the applicator-fixing tube 33 which protrudes through the wiper-mounting hole 22. In a state where the applicator-attached cap 30 is fixed to the shoulder portion 20, after the inner surface of the inlet side of the container portion 10 of the molding film 60, on which the molding of the handle-package portion 40 and the tear-off inducing line 50 is formed, is brought into contact with a curved front surface of the shoulder 21, the surfaces are integrally fixed by known heat, ultrasonic, or high frequency bonding methods.

In this state, the applicator 34, which is sandwiched between the wiper B and the applicator-fixing tube 33, is located inside the container portion 10 and a handle 32 of the applicator-attached cap 30 is located inside the handle-package portion 40.

If the back surface of the shoulder 21 and a flange portion of the molding film 60 are thermally bonded through the lead film 61 after the liquid contents A is supplied into the container portion 10 in such a state, the container portion 10 and the handle-package portion 40 are packed in a state in which the liquid contents A and the handle 32 are sealed.

As shown in FIGS. 1 and 3, the container portion 10 and the handle-package portion 40 are integrally connected to each other and the entire liquid contents A and the applicator-attached cap 30 are completely blocked from external contact before use.

Therefore, the applicator-attached cap 30 is prevented from coming into contact with or inflow of foreign substance or being opened in an unauthorized manner, thereby ensuring the safety and reliability of the product.

Further, the upper portion of the wiper B as an outlet of the container portion 10 is blocked by the inner surface of the coupling male-thread portion 31 of the applicator-attached cap 30 so there is no possibility of leakage of the liquid contents A unless the applicator-attached cap is detached from the wiper B as the coupling male-thread portion 31 is disengaged from the coupling female-thread portion 23.

Figure 5:
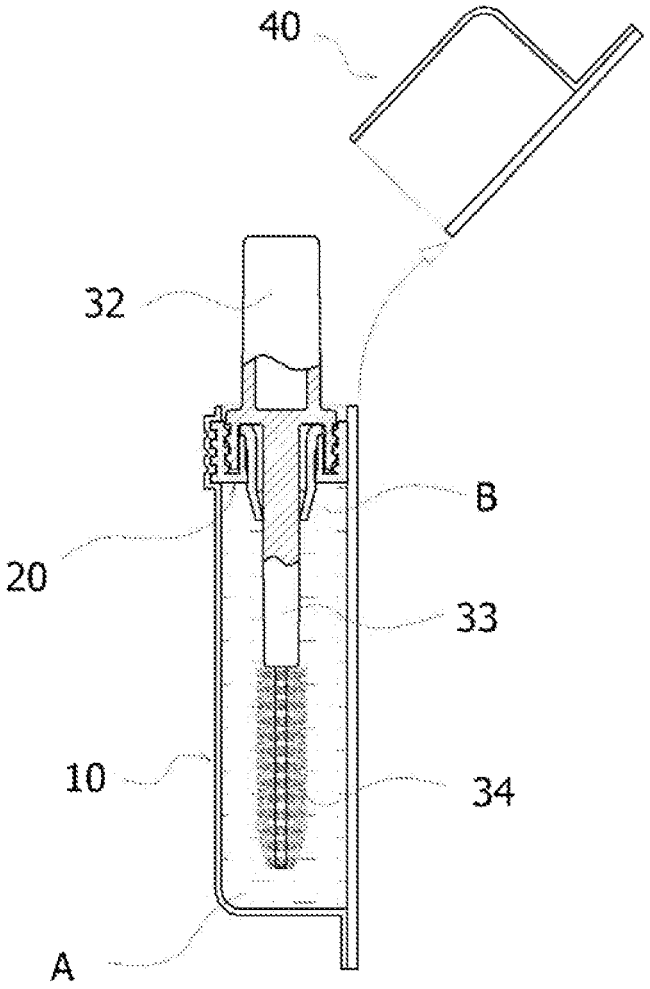
FIG. 5 is an exemplary cross-sectional view illustrating a state in which a handle of an applicator-attached cap is exposed by removing the handle-package portion for use of the product of the present invention.

In order to use the applicator-attached cap 30 impregnated with the liquid contents in such a state, when holding the container portion 10 with one hand while gripping the handle portion 40 with the other hand and deflecting it in the direction of indicated by an arrow, the tear-off inducing line 50, which is weak to such action, will start to rip and once it is completely cut off, the handle-package portion 40 is cut and separated to expose the handle 32, as shown in FIG. 5.

Figure 6:
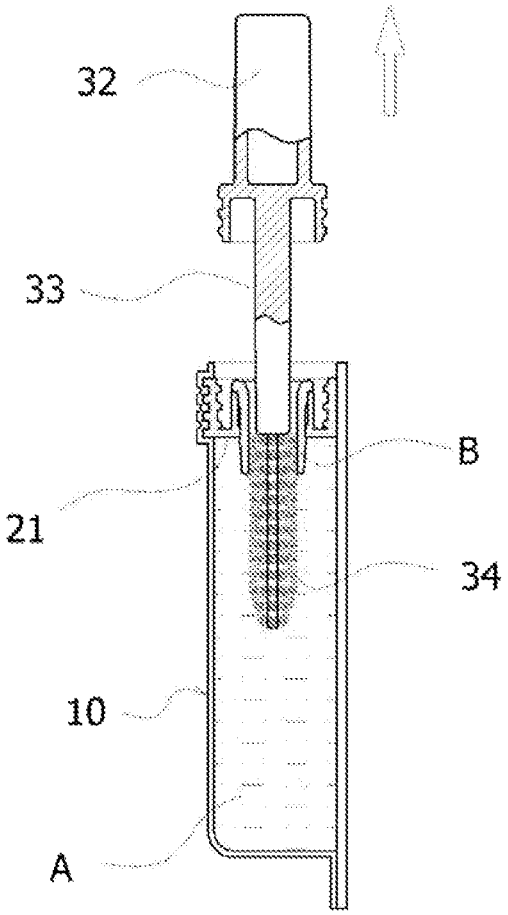
FIG. 6 is an exemplary cross-sectional view illustrating a state in which the wipers wipe the contents liquid from the applicator with the applicator-attached cap being drawn out.
Figure 7:
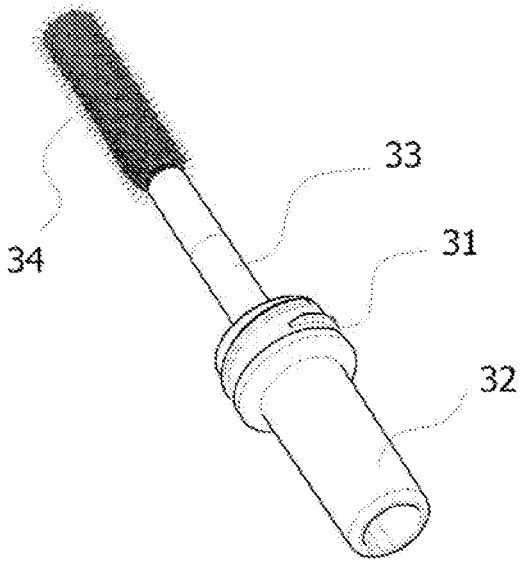
FIG. 7 is a perspective view of the drawn applicator-attached cap.
Figure 8:
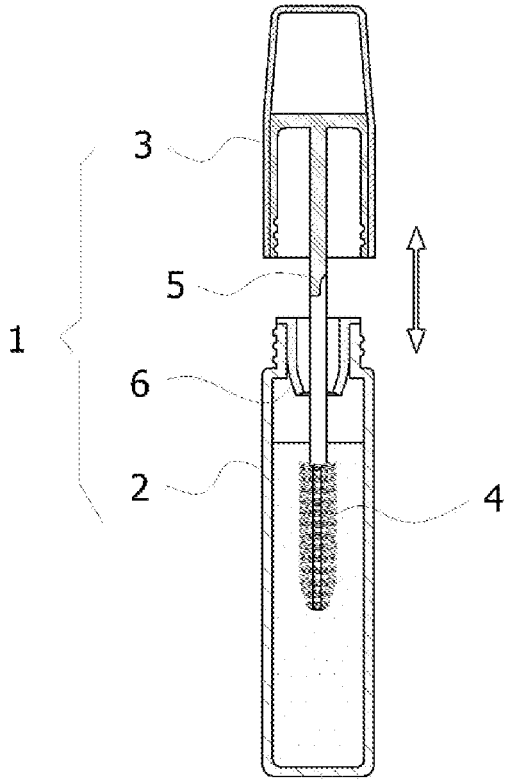
FIG. 8 is an exemplary cross-sectional view showing a conventional structure of an applicator storage container.

In the state where the handle-package portion 40 is removed, when the applicator-attached cap 30 with a brush attached thereto is pulled out after being detached from the shoulder 21 by rotating the handle 32 in the loosening direction, the liquid contents A on the applicator 34 is wiped on the wiper B as shown in FIG. 6, and only a predetermined amount is left on the applicator 34 to be drawn out and used.

Meanwhile, after use, the applicator-attached cap 30 pushes the applicator 34 into the hole of the wiper B and the coupling male-thread portion 31 is rotated in the fastening direction to block the inlet of the container portion 10, and the container portion 10 is resealed, and it is possible to use it several times until the liquid contents A is used up.

While the present invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

REFERENCE NUMERALS

A: Liquid contents
B: Wiper
10: Container portion
20: Shoulder portion
21: Shoulder
22: Wiper-mounting hole
23: Coupling female-thread portion
30: Applicator-attached cap
31: Coupling male-thread portion
32: Handle
33: Applicator-fixing tube
34: Applicator
35: Applicator support
40: Handle-package part
50: Tear-off inducing line

What is claimed is:

1. A blister package having an applicator therein, comprising;

a shoulder portion comprising a shoulder, a wiper mounting hole located in a center of the shoulder, a wiper provided in the wiper mounting hole, and a coupling female-thread portion concavely formed around the wiper mounting portion;

an applicator-attached cap adapted to be provided in the shoulder portion, and wherein the applicator-attached cap comprises a handle, a coupling male-thread portion to fasten to the female-thread portion of the shoulder portion, and an applicator fixing tube having one end coupled to the handle through the coupling male-thread portion;

the applicator having an applicator support fixed to the applicator-fixing tube through the shoulder portion and the wiper; and a container formed by bonding a molding film and a cover film together to enclose the shoulder portion, the applicator-attached cap, and the applicator as the blister package, wherein the container includes a container portion surrounding the shoulder portion and the applicator and forming a space for accommodating liquid contents, a handle-package portion surrounding the applicator-attached cap for protecting the applicator-attached cap, and a tear-off inducing line formed between the container portion and the handle-package portion as a cut line for allowing the handle-package portion to be separated from the container portion, and wherein the wiper of the shoulder portion adjusts an amount of liquid content on the applicator.

2. A blister package, comprising:

a molding film;

a cover film bonded to the molding film, wherein the molding film and cover film package an article;

a handle-package portion formed on an upper portion of the molding film, wherein the handle-packaging portion includes a tear-off inducing line;

a container portion formed on the molding film to accommodate liquid content therein; and a shoulder portion provided in an upper portion of the container portion, wherein the shoulder portion comprises a shoulder, a wiper mounting hole located in a center of the shoulder, a wiper provided in the wiper mounting hole, and a first coupling portion concavely formed around the wiper mounting portion.

* * * * *